US005632861A

United States Patent [19]

Crouse

[11] Patent Number: 5,632,861

[45] Date of Patent: May 27, 1997

[54] ALLOY COATING FOR WET AND HIGH TEMPERATURE PRESSING ROLL

[75] Inventor: Jere W. Crouse, Beloit, Wis.

[73] Assignee: Beloit Technologies, Inc., Wilmington, Del.

[21] Appl. No.: 488,988

[22] Filed: Jun. 8, 1995

[51] Int. Cl.[6] ..... D21F 3/08; C22C 38/22

[52] U.S. Cl. ..... 162/358.1; 162/358.5; 492/54; 492/58

[58] Field of Search ..... 162/358.1, 358.5, 162/359.1; 492/53, 54, 58, 59

[56] References Cited

U.S. PATENT DOCUMENTS

| | | | |
|---|---|---|---|
| 4,064,608 | 12/1977 | Jaeger | 492/54 |
| 4,316,769 | 2/1982 | Dahl | 162/360 |
| 4,374,721 | 2/1983 | Hara et al. . | |
| 4,462,957 | 7/1984 | Fukui et al. . | |
| 4,692,305 | 9/1987 | Rangaswamy et al. . | |
| 4,725,512 | 2/1988 | Scruggs | 428/678 |
| 4,748,736 | 6/1988 | Miihkinen | 492/54 |
| 4,822,415 | 4/1989 | Dorfman et al. . | |
| 5,082,533 | 1/1992 | Pulkowski et al. | 162/359 |
| 5,111,567 | 5/1992 | Leino | 492/54 |
| 5,171,404 | 12/1992 | Ellis et al. | 162/206 |
| 5,272,821 | 12/1993 | Orloff et al. | 162/374 |
| 5,327,661 | 7/1994 | Orloff | 162/289 |
| 5,334,125 | 8/1994 | Vahapesola | 492/58 |

FOREIGN PATENT DOCUMENTS

| | | | |
|---|---|---|---|
| C4210997 | 1/1993 | Germany . | |
| 2169381 | 7/1986 | United Kingdom | 162/358.1 |
| 2180624 | 4/1987 | United Kingdom . | |

*Primary Examiner*—Karen M. Hastings

*Attorney, Agent, or Firm*—Dirk J. Veneman; Raymond W. Campbell; David J. Archer

[57] ABSTRACT

A high temperature pressing roll has a cast or formed steel roll which is coated with a molybdenum-containing alloy. The preferred alloy has 14 to 16 percent molybdenum, 28 to 30 percent nickel, 30 to 34 percent chromium, 1.2 to 1.8 percent silicon, 4 to 4.5 percent boron, a maximum of 0.2 percent carbon and copper between 3 and 3.8 percent with the balance being iron. The roll is first coated with a bonding coating consisting of nickel and chromium. This bonding layer is then flame sprayed or plasma sprayed with a molybdenum alloy. The coating once applied is ground to a 30 RA or smoother surface. The molybdenum alloy is sprayed on to achieve a surface depth of approximately forty thousandths of an inch.

1 Claim, 1 Drawing Sheet

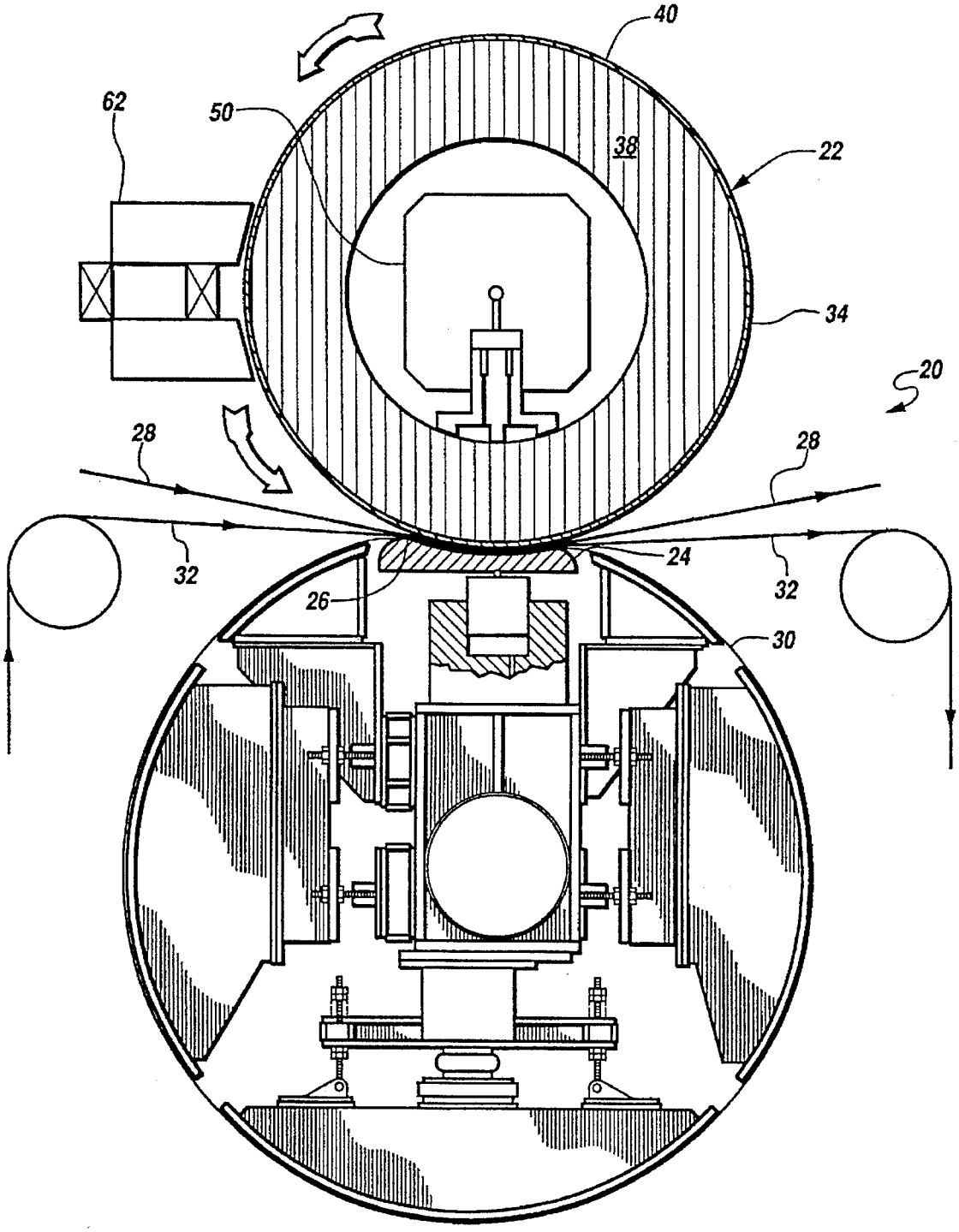
40
62
50
38
22
34
20
28
28
32
24
32
26
30

ALLOY COATING FOR WET AND HIGH TEMPERATURE PRESSING ROLL

FIELD OF THE INVENTION

This invention relates to the pressing section of papermaking machines in general and to the composition of pressing rolls in particular.

BACKGROUND OF THE INVENTION

Paper manufacture is a capital intensive industry. Demands for increased productivity have led to papermaking machines which produce wider and wider webs. Currently, machines which yield a continuous web of paper in the range of 400 inches wide are known. Papermaking machines running at 6,000 feet per minute are now considered practical.

A papermaking machine can be divided into four sections: The forming section, where paper is formed from a dilute suspension of wood fibers in water and dewatered for example on a fourdrinier screen or wire. A pressing section where the newly formed mass of fibers is pressed to remove water until the remaining water content is thirty to seventy percent of the weight of the paper. A dryer section where the paper is dried to a moisture content generally in the neighborhood of five percent. And finally a winder where the paper is reeled up for transportation, storage, further processing or sale.

As papermaking speeds have increased, the size of the drying section has had to increase as well. Thus, the drying section of the papermachine represents a substantial capital cost especially as paper speeds have increased. The drying section also is the principal user of energy in the papermaking process. These attributes of the drying system have focused attention on improving the efficiency of the pressing section to decrease the moisture content from seventy percent to fifty percent or less. One method of achieving this is hot pressing in an extended nip press (ENP).

In an extended nip press an elongate concave shoe is pressed against a backing roll to define therebetween an extended pressing section for the passage therethrough of a paper web. A looped bearing blanket extends through the pressing section and slidably engages the concave surface defined by the shoe such that the web is carried by the blanket through the pressing section. A backing felt also extends through the pressing section and underlies the paper web.

The primary advantage of the extended nip press is the increased residence time of the web in the pressing section. More particularly, by heating the backing roll to a high temperature, water vapor generated within the extended pressing section further assists in pushing water remaining in the web in the liquid phase into the backing felt.

A problem that has been experienced with heated extended nip presses is the tendency for the pressed paper web to stick to the outer surface of the backing roll after the paper web has left the extended nip. In the past, granite rolls have been used in pressing sections of papermaking machines for the excellent release characteristics of their surfaces. The use of granite rolls presents several challenges in modern high temperature extended nip presses. The first is difficulty of supporting the somewhat brutal granite roll in contact with the extended nip, especially as the width of the paper web being manufactured becomes increasingly large. The second problem is the relatively low thermal conductivity of granite which limits the amount of heat which can be put into the paper web at high forming speeds. A third and not unimportant disadvantage of granite rolls is their high procurement costs. A fourth disadvantage is that heat can cause the granite roll to crack and fail.

Thus, because of the aforementioned problems of granite, metal backing rolls are utilized in high temperature extended nip presses. To overcome the problem of sticking, the upstream surface of the heated backing roll has been sprayed with an atomized layer of releasing agent. However, such releasing agents are not only relatively costly but present the possibility of deleteriously affecting the resulting pressed web. Experiments have been carried out with a steel backing roll with a chromium plated surface. However, such chromium plated surfaces have not been altogether successful in providing a uniform release of a pressed web.

What is needed is a backing roll with a surface which will readily release a paper web after hot pressing.

SUMMARY OF THE INVENTION

The high temperature pressing roll of this invention employs a cast or formed steel roll which is coated with a molybdenum-containing alloy. The preferred alloy being 14 to 16 percent molybdenum, 28 to 30 percent nickel, 30 to 34 percent chromium, 1.2 to 1.8 percent silicon, 4 to 4.5 percent boron, 0.2 percent carbon maximum and copper between 3 and 3.8 percent with the balance being iron.

The backing roll is first coated with a bonding coating consisting of a chromium and nickel mixture, an exemplary composition is 60 percent nickel and 40 percent chromium. This bonding layer is then flame sprayed or plasma sprayed with a molybdenum alloy. Molybdenum alloys from 3 to 70 percent have been found to have improved release characteristics with the most effective molybdenum content to date found to be 14 percent. A minimum chromium content of 25 percent has been found necessary to prevent corrosion of the roll's surface. A nickel content of at least 20 percent has been found necessary to get an alloy with sufficient heat transfer capabilities to maximize performance in the high temperature extended nip press. The coating once applied is ground to a 30 RA or smoother surface. The molybdenum alloy is sprayed on to achieve a surface depth of approximately forty thousandths of an inch. In some cases, a thicker coating may be possible if the coating is applied to the roll when the roll is at its operating temperature of three to five hundred degrees Fahrenheit.

It is a feature of the present invention to provide a roll for extended hot nip pressing of a paper web which has improved release characteristics.

It is another feature of the present invention to provide an extended hot nip press which avoids blistering of the paper web or picking of fibers from the web.

It is a further feature of the present invention to provide a press roll for an extended hot nip press which resists corrosion from the chemical constituents normally present in a paper web being pressed and dried.

It is also a feature of the present invention to provide a pressing roll for an extended hot nip press which combines a surface with good release characteristics, corrosion resistance, and thermal conductivity.

Further objects, features and advantages of the invention will be apparent from the following detailed description when taken in conjunction with the accompanying drawings.

BRIEF DESCRIPTION OF THE DRAWING

The drawing is a side elevational, cross-sectional view of an extended nip hot press, showing a pressing roll of this invention which employs a coating of high molybdenum content.

DESCRIPTION OF THE PREFERRED EMBODIMENT

Referring more particularly to the drawing wherein like numbers refer to similar parts, a hot extended nip press dryer 20 has a pressing roll 22 which forms a nip 26 with a shoe 24. The pressing roll is heated, for example by the induction heater 62. The shoe 24 is provided with a concave surface facing the roll 22 and is mounted so that it is urged upwardly towards the roll 22. The press nip 26 is formed between the roll 22 and the shoe 24. A web of paper 28 passing through the nip 26 is subjected to a pressing pressure over an extended length of time. In experiments done to date, residency times of five (5) to three hundred (300) milliseconds have been employed with the press roll 22 having a surface 34 coated with a molybdenum-containing alloy. A press felt 32 moves beneath the web 28 and a looped belt 30 extends over the shoe 24 and supports the web 28 and felt 32 as they pass through the nip 26.

Oil is supplied between the shoe 24 and the belt 30. The oil causes a hydrodynamic wedge of fluid to build up between the belt 30 and the shoe 24. The fluid wedge transmits pressure to the web while at the same time lubricating the movement of the web 28 through the nip 26. The paper web 28, the press felt 32 and the belt 30, as well as the roll 22, are engaged and so driven at the same speed.

The intimate engagement of the web 28 with the pressing roll surface 34 under pressure facilitates the rapid heat exchange between the surface 34 of the roll 22 and the web 28. The rapid heat transfer between the roll 22 and the web 28 produces a not completely understood drying mechanism which is characteristic of the heated extended nip press. The rapid heating of a paper web vaporizes some of the water contained in the web. The steam which has been produced from the water in the web is trapped between the surface 34 of the roll 22 and the paper web 28. Its only route of escape is through the paper web 28 into the pressing felt 32. The rapid downward movement of the steam from the upper surface of the paper web 28 downward into the pressing felt 32 has the effect of blowing water contained in the web 28 into the pressing felt 32. This process, impulse drying, results in the rapid removal of water from the paper web 28.

As the paper web 28 passes through the extended nip, it can become adhered either to the pressing felt 32 or the press roll 22. In the ideal press, the paper web adheres to neither the roll surface 34 nor to the press felt 32. If the paper adheres to the roll surface 34, individual fibers from the paper web are torn partially or completely from the web's surface, a phenomena known as "picking of fibers." Furthermore, adherence to the roll surface 34 may cause blistering or separation between upper and lower portions of the web, especially in liner board. On the other hand, if the web adheres to the pressing felt, the water which has been moved into the pressing felt by heat and pressure is reabsorbed by the paper, limiting the effectiveness of the hot press. Thus, it is important that the adherence between the roll surface 34 and the press felt 32 be balanced and that the adherence to both surfaces be minimal.

The press roll 22 with improved release characteristics of this invention is formed by flame-spraying a forty-thousandths-of-an-inch thick layer of an alloy containing molybdenum on the roll. The preferred material is comprised of fourteen to sixteen percent molybdenum, twenty-eight to thirty percent nickel, thirty to thirty-four percent chromium, 1.2 to 1.8 percent silicon, 4 to 4.5 percent boron, 0.2 percent or less carbon, and copper between 3 and 3.8 percent with the balance being iron. This composition is a modification of Armacor C alloy. Armacor C is available from Amorphous Metal Technologies, Inc., 1005 Meuirlands, Suite 5, Irvine, Calif. 92718. Armacor C typically contains forty percent chromium, thirty percent nickel, five percent boron, four percent molybdenum, four percent copper, and three percent silicon, with the balance being iron.

To date, alloys containing four percent molybdenum, seven percent molybdenum, fourteen percent molybdenum, and seventy percent molybdenum have been tested. Of these alloys the fourteen percent molybdenum and seventy percent molybdenum alloys have the best release characteristics with the fourteen percent molybdenum having better thermal conductivity and so better heat transfer properties. Heat transfer rates are important because it is the amount of heat which can be transferred to the paper web as it transits the nip which determines whether high speed drying can take place.

In an extended heated nip, it is desirable for the press roll 22 to be maintained at three hundred to five hundred degrees Fahrenheit. The high surface temperature of the roll rapidly heats the wet web as it passes through the nip and softens the paper fibers. This greatly enhances the removal of water and development of strength properties of the paper web. With these higher roll temperatures, however, sheet release of the web off the press roll can be difficult, thus necessitating rolls with better release characteristics.

Granite rolls have historically been used in paper presses for their excellent release characteristics. Granite rolls nonetheless have properties which make their use undesirable for heated extended nip presses on modern papermaking machines. First, heating of a granite pressing roll is impractical and even dangerous. Secondly, granite rolls are expensive, especially in the lengths of one hundred to four hundred inches necessitated by modern papermaking machines. Lastly, a crown control system 50 such as shown in the drawing is less practical in a granite roll. Flexing caused by the long width of the roll can lead to roll cracking in granite rolls, thus the necessity of using metal rolls.

Metal rolls, however, conventionally fabricated of cast steel, cast iron or fabricated out of iron plate, have undesirable release characteristics which must be modified by adhering a coating thereto. The coating 40 described herein is typically applied by flame or plasma spraying in the form of a metal powder or wire which is melted and sprayed onto the cylindrical roll surface of the stainless steel, steel or iron roll 38. To improve the bonding between the coating and the roll surface, the roll may be first coated with a bonding coating consisting of a chromium and nickel mixture, for example, a sixty percent (60%) nickel, forty percent (40%) chromium alloy, which is then overlaid with a molybdenum-containing alloy.

Because the molybdenum-containing alloys typically have thermal coefficients of expansion which are less than that of the iron, if the layer exceeds approximately forty thousandths of an inch, there is a tendency for the coating to craze or crack when the roll is heated to operating temperature. This may be overcome by flame spraying the molybdenum alloy when the backing roll has been heated to its working temperature.

Molybdenum alloys having the desirable release characteristics may contain between three percent molybdenum with the balance of ninety-seven percent chosen from chromium, nickel, iron, boron, copper and silicon, and spanning the range up to alloys having seventy-five percent molybdenum with a balance of twenty-five percent chosen from chromium, nickel, iron, boron, copper, and silicon. The aforementioned alloys may be made without significant quantities of iron and copper.

Practical alloys, however, should contain sufficient chromium to prevent corrosion and through experimentation this has been found to be a minimum of approximately twenty-five percent. Thermal conductivity for heat transfer is also important and this implies a nickel content of at least twenty percent. Thus, a group of practical alloys would contain between three and fifty-five percent molybdenum, between twenty-five and forty percent chromium, and at least twenty percent nickel.

Another useful alloy combination is composed of 6.7 percent molybdenum, 32 percent chromium, 29 percent nickel, 28 percent iron, 3.74 percent boron and 3.7 percent copper.

In some cases, it may be desirable to produce a coating with up to thirty percent porosity. This is accomplished by including in the material to be flame sprayed or plasma sprayed onto the roll 22 a quantity of plastic which evaporates leaving the coated surface porous. The porosity is preferably filled with Teflon. Teflon may be applied by spraying at high pressure or by injecting into the pores.

It is also important to recognize that roll coating alloys herein disclosed could be used to form ceramic metal coatings known as CerMet. Thus, the metal alloys together with $ZrO_2$, $Al_2O_3$, Moly-Chromium-Alumina, Chromium-Alumina, $SiO_3$, BeO, MgO, CaO, or $ThO_2$ may by combined by flame spraying on to the roll to form coatings which bring together the release characteristics of the molybdenum-containing alloys and the release characteristics of ceramics. In particular, experiments performed have shown that zirconium oxide and the aluminum oxide have excellent release characteristics. While the ceramics provide excellent release characteristics, their heat transfer characteristics are not as high and hence not as desirable. Thus, combinations of the two, particularly combinations containing fifty percent or more metal, have desirable characteristics.

It should be noted that the roll of this invention may also be used in a calender in a papermaking machine.

It is understood that the invention is not limited to the particular construction and arrangement of parts herein illustrated and described, but embraces such modified forms thereof as come within the scope of the following claims.

I claim:

1. A roll in a papermaking machine comprising;

a roll formed of a first metal, said roll defining an outermost cylindrical surface;

a metal alloy layer coated on said outermost cylindrical surface of the roll;

said metal alloy layer consisting essentially of;

14 to 16 percent molybdenum;
28 to 30 percent nickel;
30 to 34 percent chromium;
1.2 to 1.8 percent silicon;
4 to 4.5 percent boron;
0.2 to 0 percent carbon;
3 to 3.8 percent copper;

with the balance being iron; and said metal alloy inhibiting sticking of a paper web on said roll.

* * * * *